US006742811B2

(12) United States Patent
Mazza

(10) Patent No.: US 6,742,811 B2
(45) Date of Patent: Jun. 1, 2004

(54) EDITORIAL OR STATIONERY ARTICLE, SUCH AS DIARY, EXERCISE-BOOK, BOOK, MAGAZINE, NEWSPAPER, FILE-HOLDER, ETC., HAVING SPECIAL ERGONOMIC FEATURES

(75) Inventor: Marco Mazza, Bergamo (IT)

(73) Assignee: Zamaz S.r.l., Milan (IT)

( * ) Notice: Subject to any disclaimer, the term of this patent is extended or adjusted under 35 U.S.C. 154(b) by 0 days.

(21) Appl. No.: 10/176,836

(22) Filed: Jun. 21, 2002

(65) Prior Publication Data

US 2002/0163176 A1 Nov. 7, 2002

Related U.S. Application Data

(63) Continuation of application No. PCT/IT00/00552, filed on Dec. 28, 2000.

(30) Foreign Application Priority Data

Dec. 28, 1999 (IT) ..... CN990004 U

(51) Int. Cl.[7] ..... B42D 5/00

(52) U.S. Cl. ..... 283/40; 281/15.1; 281/29; 281/51; 283/63.1; 434/317; D19/26

(58) Field of Search ..... 281/15.1, 29, 36, 281/37, 38, 51; 283/40, 63.1, 64; 434/317; D19/26

(56) References Cited

U.S. PATENT DOCUMENTS

| | | | | |
|---|---|---|---|---|
| 4,377,271 A | * | 3/1983 | Smith | 248/460 |
| 4,877,269 A | * | 10/1989 | Callaghan et al. | 283/40 |
| 5,895,165 A | * | 4/1999 | Mogelonsky | 402/79 |
| 2002/0163176 A1 | * | 11/2002 | Mazza | 281/29 |

FOREIGN PATENT DOCUMENTS

| | | |
|---|---|---|
| DE | 1160 405 | 1/1964 |
| FR | 2 671 760 A1 | 7/1992 |

* cited by examiner

*Primary Examiner*—Monica S. Carter
(74) *Attorney, Agent, or Firm*—Akin Gump Strauss Hauer & Feld, LLP

(57) ABSTRACT

An editorial and stationery article, such as a diary, exercise-book, book, magazine, newspaper, file-holder, etc., having particular ergonomic features, characterized in that it has a structure that can be opened as a book, with sheets or pages of quadrilateral shape, with the back or spine side oblique to the upper and lower sides, so that in the open position at least the lower sides converge towards the opening central axis, with convergence according to the obliquity angle of the spine side with respect to said upper and lower sides, so as to have a substantially user-enveloping configuration.

9 Claims, 3 Drawing Sheets

EDITORIAL OR STATIONERY ARTICLE, SUCH AS DIARY, EXERCISE-BOOK, BOOK, MAGAZINE, NEWSPAPER, FILE-HOLDER, ETC., HAVING SPECIAL ERGONOMIC FEATURES

CROSS-REFERENCE TO RELATED APPLICATION

This application is a continuation of International Application No. PCT/IT00/00552, filed Dec. 28, 2000, which was published in the English language on Jul. 5, 2001 under International Publication No. WO 01/47712 A1 and the disclosure of which is incorporated herein by reference.

BACKGROUND OF THE INVENTION

The present invention relates to an editorial and stationery article, such as, e.g., a diary, exercise-book, register, book, magazine, newspaper, file-holder, address-book, etc.

Object of the invention is enabling, during the use, that is, in the active conformation, a better harmony with the physiological functionality of the human anatomical structure with respect to the already known above mentioned articles, both while reading and writing, in harmony with the natural movements peculiar to the human body and to the morphological human features, thus enabling a field of vision having an arched shape while reading as well as while writing when the object is used for writing, so as to reduce the motility of the wrist and of the thumb-forefinger pliers which support the writing instrument, and to better suit the wrist articulation, thus rendering the writing movements easier and more natural, and reducing the visual and muscular stresses of the user during said uses, with respect to the normally and traditionally imposed body positions while using articles of the above mentioned kind.

Another object is further reducing stressing events and to be in greater harmony and sintony with the physiological functionality of the human anatomical structure, also during the non-use passive conformations, such as for example a better ease of handling and seizing it while walking, while moving or transporting the product, or while standing, or while placing the product from the archives or taking it from the suitable holding and filing structures, such as bookcases, shelvings, etc.

A further object is providing a practical, simple, functional and advantageous solution, both for manufacture and ease of use.

BRIEF SUMMARY OF THE INVENTION

These objects are achieved by the invention by providing an editorial and stationery article, such as a diary, exercise-book, book, magazine, newspaper, file-holder, etc., having particular ergonomic features, characterized in that it has a structure that can be opened as a book, with sheets or pages of quadrilateral shape, with the back or spine side oblique to the upper and lower sides, so that in the open position at least the lower sides converge towards the opening central axis, with convergence according to the obliquity angle of the spine side with respect to said upper and lower sides, so as to have a substantially user-enveloping configuration.

BRIEF DESCRIPTION OF THE SEVERAL VIEWS OF THE DRAWINGS

These and other features of the invention and the advantages deriving therefrom will appear from the following detailed description of some embodiments, given as non-limiting examples, illustrated with reference to the accompanying drawings, wherein:

FIGS. 3 to 6 show the product in some different conditions of use and precisely while writing in FIG. 3, while reading in the case that the product is intended to be a magazine or book in FIG. 4, while reading in the case that the product is intended to be a newspaper in FIG. 5, whereas FIG. 6 shows the seizing with a hand of a product according to the invention, e.g. a diary;

DETAILED DESCRIPTION OF THE INVENTION

Figure 1:
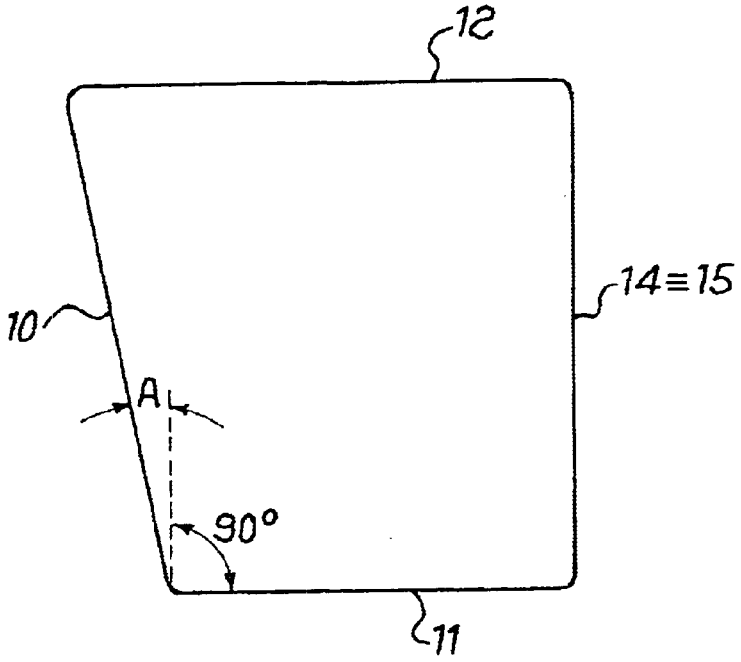
FIG. 1 is a top frontal view of a product according to the invention, in the closed position.
Figure 2:
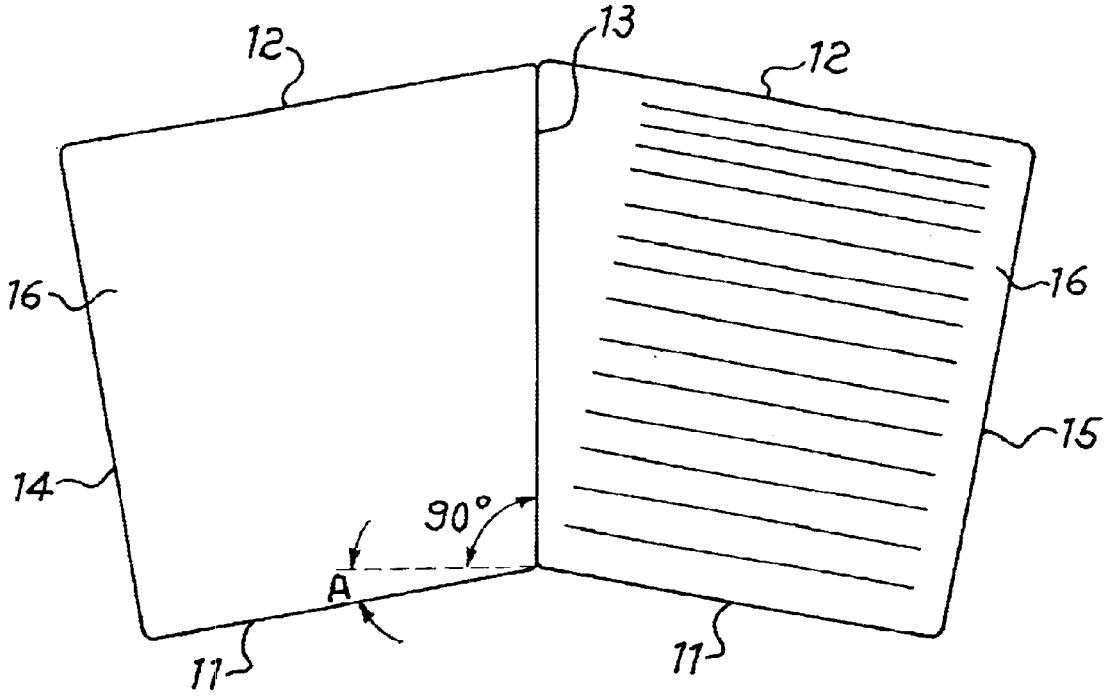
FIG. 2 shows the same product in the open position, in a top frontal view and laying on a plane.

With reference to the figures and first to FIGS. 1 and 2 the product according to the invention has a structure that can be opened as a book, with sheets or pages 16 of quadrilateral shape, with the back or spine side 10 oblique to the upper and lower sides 11 and 12, so that in the open position (FIG. 2) at least the lower sides converge towards the opening central axis 13 at the back 10, with convergence according to the obliquity angle A of the spine side 10 with respect to said upper and lower sides 11, so as to have a substantially user-enveloping configuration.

Said obliquity angle A can have any suitable value and preferably is lower or equal to 45°.

According to a preferred embodiment, said obliquity angle A is about 10°.

In the illustrated embodiments and according to a preferred embodiment, the sheets or pages 16 have the shape of right-angled trapezium (FIGS. 1 and 2) wherein the oblique side coincides with the back or spine side 10 along which the opening occurs according to axis 13, the lower and upper sides, respectively 11 and 12, which are therefore parallel to each other, whereas in the opened position (FIG. 2) the two sides, respectively 14 and 15, which are symmetrically facing the opening central axis 13 are converging towards the user and the two lower sides 11 are oriented as to converge towards the opening central axis 13.

According to the particular feature of the invention, the product is provided with particular ergonomic features, which enable the visual and muscular stresses to be reduced when it is in the active conformation that is while reading or writing, according to the destination of use, with respect to the body positions normally and traditionally imposed during the above mentioned activities.

According to another particular feature of the invention, the particular ergonomic features enable the stressing events to be further reduced and to be in greater harmony and syntony with the anatomical physiology of the human body even during the passive conformations (closed position of the product) of non-use, for example while moving or transporting the object, while the user is standing, walking, or while he is placing or taking the product from the suitable holding and filing structures, such as book-cases, shelvings, etc.

FIGS. 3 to 6 show the product as an article on which it is possible to write, such as a register or an exercise-book Q. The conformation of the product and the possibility to write according to suitably inclined lines which altogether have a substantially arched and enveloping shape with respect to the body of the user, make lighter the motility of the wrist and of the thumb-forefinger pliers which support the writing instrument (not shown), and the angle which is necessary for reaching every side of the volume is reduced; the elbow does not need any more to move away from the chest and the shoulder does not need to be involved in the effort. It follows that the complex writing function, which requires small, fine movements, coordinated by many articulations and by a considerable muscular work, is made easier.

Figure 4:
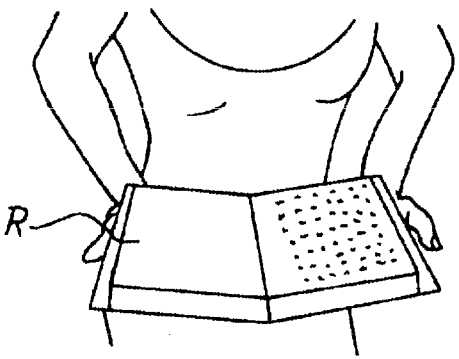
Figure 3:
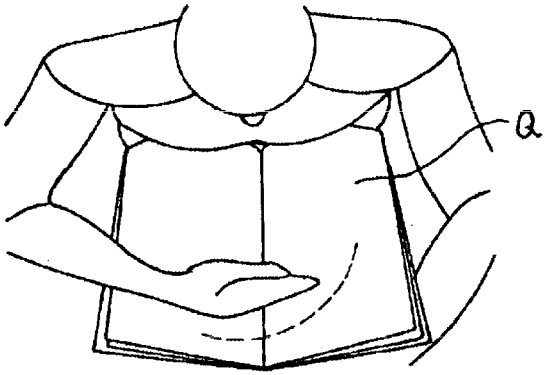
Figure 5:
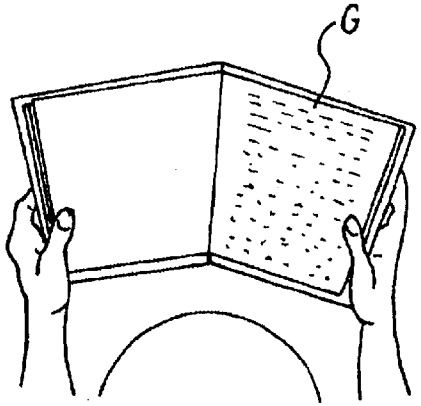

FIGS. 3 and 4 refer to the use of the product when it is used for reading, e.g., of a magazine or book R in FIG. 4 and newspaper G in FIG. 5, respectively. The misalignment of the two sides 11 due to the obliquity angle A (FIGS. 1 and 2) when the product is open (FIG. 2), is well adapted to the physiological angulation which is provided at the wrist; the fulcrum consisting in the spine between the misaligned pages matches and coincides with the articulation of the supporting wrist and makes easier the physiological prehensile function. Particularly, the functional syntony between the morphological features of the product and the physiological functions of the human anatomical structure has to be considered. In fact, the socially imposed positions of the body, such as sitting on chairs having the back at 90°, the twisting movements of the bust for using the telephone or computer keyboards, do not respect the postural hygiene as indicated by the specialists of the field who are oriented towards the prevention; the defective positions also involve a stressing effort for the eye motility, which is generally forced in an unnatural alignment of the extrinsic eye musculature along parallel lines; also the cervical column position and functionality while sitting, standing or laying must be more mobile and less compelled to carry out forced and unnatural movements.

Therefore, the product according to the invention reduces the stress of the eye musculature and on the control of the cervical vertebra and back of the neck, thus enabling a visual field of an arched shape while reading; also in the laying position the volume can be easily supported by the crossed arms and reading appears physiological according to an arched line along the frontal body wall.

Figure 6:
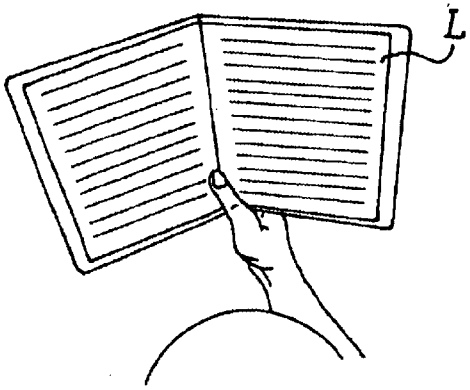

FIG. 6 shows another situation of use for reading for example a book or diary L, which is held in one hand, thus confirming the handling ease, due to the misalignment of the two sides 11 (FIG. 2) in the open position which is adapted in a natural way to the physiological angulation of the supporting wrist.

Figure 7:
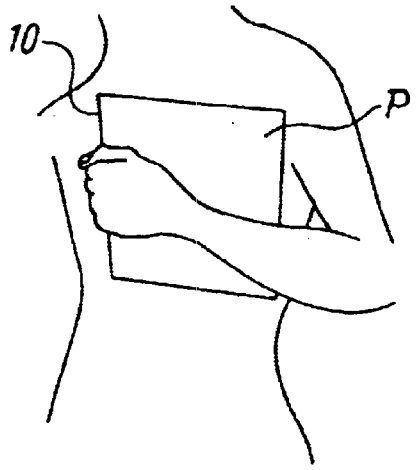
FIGS. 7 to 10 show the product according to the invention in passive conformations, that is, of non-use (writing or reading) and precisely in the case that the user is standing and walks while holding the product next to his chest in FIG. 7 and next to his side in FIG. 8, while placing it into archives in high shelvings in FIG. 9 and in low shelvings in FIG. 10.
Figure 8:
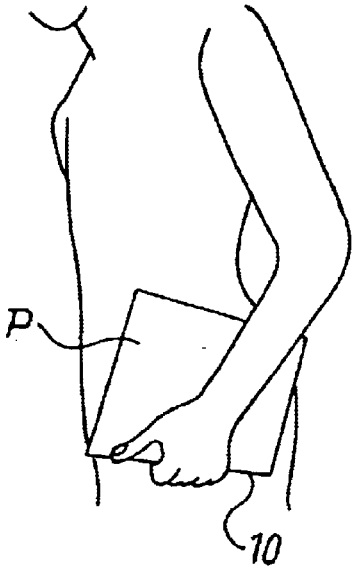

Still according to the above mentioned features of syntony with morphological and goniometric human factors due to the above mentioned obliquity angle A (FIGS. 1 and 2), particularly in syntony and harmony with the physiological angulation which is provided at the wrist and of the articulation of the fingers of the hand while seizing, advantageous ergonomic features are conferred to the product also in the situations of non-use (passive conformation) in the closed positions (FIGS. 7 to 10), for example while the product is moved, while walking, standing, such as in the situation of FIG. 7 while seizing and gripping the product P along back 10 and carrying it at the user's chest, or while seizing and gripping the product P along back 10, carrying it at the side as shown in FIG. 8.

Figure 9:
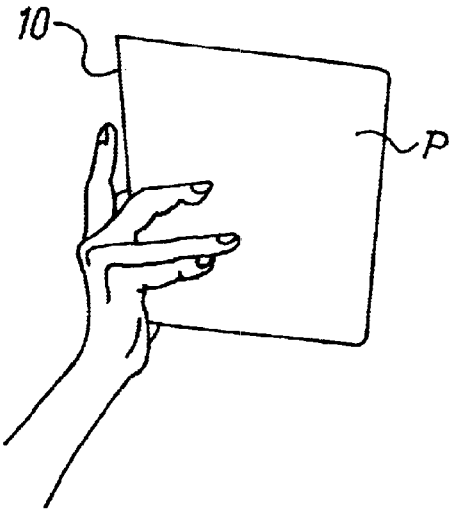
Figure 10:
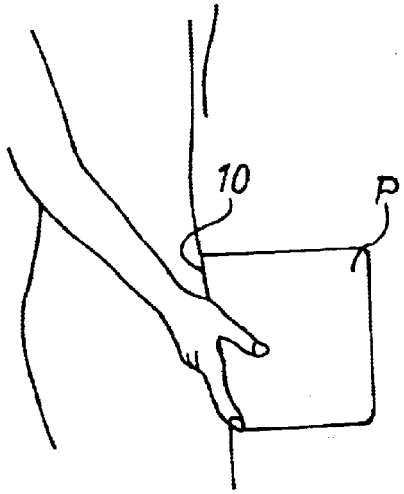

Still according to the above mentioned concepts, the seizing in further situations of passive conformation is made easier, such as placing the product P in shelvings or other holding structures, upwards, while the seizing fingers are oriented upwards along back 10, as shown in FIG. 9, or placing the product P in shelvings and the like, downwards, while the seizing fingers are oriented downwards along back 10, as shown in FIG. 10.

Figure 11:
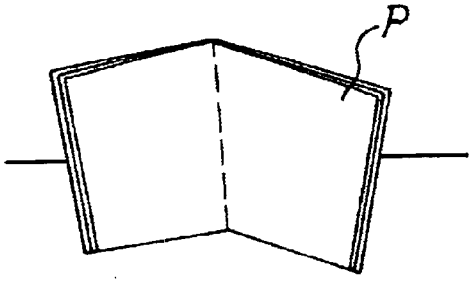
in FIG. 11 a product according to the invention is illustrated in an open position on a horizontal plane.

FIG. 11 shows a product P according to the invention which can be easily arranged in the open position on a horizontal plane, as if on a reading desk, thanks to the above mentioned conformation.

Still in the passive conformation, that is, in the closed position, the product according to the invention has further advantages, such as for example that it is easily located by the user for a ready consultation, because its back 10, thanks to the obliquity of angle A, is projecting outwards thus allowing for an immediate seizing by the user.

The product according to the invention can be provided with sheets or pages 16 (FIG. 2) which can be held together by any suitable means, according to the specific destination and needs of utilization, for example by means of various types of bindings, e.g. with spiral, stitching, stapling, ligature, seams, etc., or simply with pages 16 which can be turned and opened along the opening or folding line 13, such as in newspapers.

Still according to the specific needs and destinations of use, the product according to the invention can be provided either as a single piece, or with pages or sheets 16 which can be removed or taken off, separately or in bifacial solutions, with possibility of reinserting them and restoring the initial conditions, such as in registers, file-holders, bill-books, etc.

The sheets or pages 16 can be provided in any suitable material, according to the specific needs and destinations of use, e.g. preferably in paper or cardboard. A cover of any suitable material, the same material as that used for the sheets or pages 16 or different therefrom, can be provided.

Said sheets or pages 16 can be made of a transparent laminar material, for example plastic material, having the function of containing documents or sheets therein inserted, in the case of file-holders, registers, bill-books, etc.

The invention is therefore not limited to the embodiments herewith described and illustrated, but it also comprises the models that provide for the same utility, by using the same innovative concept.

From the above, it appears that the invention can be varied and modified, altogether or in the particulars, according to the specific needs and convenience of manufacture and use, within the range of the technical and functional equivalents, without leaving the innovative concept illustrated above and claimed in the following.

What is claimed is:

1. An editorial and stationery article comprising a structure that can be opened like a book, the structure having sheets of a quadrilateral shape and a spine side oblique to upper and lower sides of the sheets, the sheets being pivotally secured to each other at the spine side along an opening central axis, such that, in an open position, at least the lower sides converge towards the opening central axis, with convergence according to an obliquity angle of the spine side with respect to the upper and lower sides, so as to have a substantially user-enveloping configuration.

2. An editorial and stationery article according to claim 1, wherein the obliquity angle has a value that is less than or equal to 45°.

3. An editorial and stationery article according to claim 1, wherein the obliquity angle is about 10°.

4. An editorial and stationery article according to claim 1, wherein the sheets are pivotally held together by a binding means, wherein the binding means is selected from the group consisting of spiral binding, stitching, stapling, ligature binding, seam binding, and folding along a folding line.

5. An editorial and stationery article according to claim 1, wherein it can be provided, according to the specific needs and destinations of use, either as a single piece, or with sheets which can be removed, separately or in bifacial solutions, with possibility of reinserting them and restoring the initial conditions.

6. An editorial and stationery article according to claim 1, wherein the sheets are made of one of paper and cardboard.

7. An editorial and stationery product according to claim 1, further comprising a cover of any suitable material, the same material as that used for the sheets or different therefrom.

8. An editorial and stationery article according to claim 1, wherein the sheets are made of a transparent laminar material for containing sheets inserted therein.

9. An editorial and stationery product according to claim 1, wherein the sheets have the shape of a right-angled trapezium such that the oblique side coincides with the back or spine side along which the opening occurs, the upper and lower sides are therefore parallel to each other, whereas in the opened position the two sides which are symmetrically facing the opening central axis are converging towards the user and the two lower sides are oriented as to converge towards the opening central axis.

* * * * *